US011629446B2

(12) United States Patent
Albert Revert et al.

(10) Patent No.: US 11,629,446 B2
(45) Date of Patent: Apr. 18, 2023

(54) SYSTEM AND METHOD FOR TREATING TEXTILE MATERIAL WITH OZONE

(71) Applicant: JEANOLOGIA, S. L., Valencia (ES)

(72) Inventors: Vicente Albert Revert, Paterna (ES); Victoria Puchol Estors, Paterna (ES); Peiming Liu, Shanghai (CN)

(73) Assignee: JEANOLOGIA, S. L., Paterna (ES)

( * ) Notice: Subject to any disclaimer, the term of this patent is extended or adjusted under 35 U.S.C. 154(b) by 223 days.

(21) Appl. No.: 17/263,681

(22) PCT Filed: Jun. 18, 2019

(86) PCT No.: PCT/ES2019/070423

§ 371 (c)(1),
(2) Date: Jan. 27, 2021

(87) PCT Pub. No.: WO2020/025840

PCT Pub. Date: Feb. 6, 2020

(65) Prior Publication Data

US 2021/0222338 A1 Jul. 22, 2021

(30) Foreign Application Priority Data

Jul. 30, 2018 (CN) ..... 201810853472.X

(51) Int. Cl.
*D06F 35/00* (2006.01)
*D06L 4/50* (2017.01)
(Continued)

(52) U.S. Cl.
CPC ..... *D06F 35/001* (2013.01); *D06B 3/04* (2013.01); *D06B 3/12* (2013.01); *D06B 3/18* (2013.01);
(Continued)

(58) Field of Classification Search
None
See application file for complete search history.

(56) References Cited

U.S. PATENT DOCUMENTS 2,727,378 A 12/1955 Cook
3,664,158 A 5/1972 Skaathun et al.
(Continued)

FOREIGN PATENT DOCUMENTS

CN 101415874 A 4/2009
CN 107190412 A 9/2017
(Continued)

OTHER PUBLICATIONS

International Search Report dated Sep. 16, 2019 in corresponding International application No. PCT/ES2019/070423; 6 pages.
(Continued)

*Primary Examiner* — Katie L. Hammer
(74) *Attorney, Agent, or Firm* — Maier & Maier, PLLC

(57) ABSTRACT

A system and a method for treating a textile material with ozone gas. The system includes: an ozone gas supply system, a hollow chamber fillable with ozone provided by said gas supply system, a textile-feeding port connected to said chamber and comprising a first liquid fillable tank, a textile-discharging port connected to said chamber and comprising a second liquid fillable tank, guide rollers, driving rollers, at least one tension compensator located inside the hollow chamber. The system is adapted for implementing the method, the latter including: using the system and providing liquid to said first and second tanks, providing ozone gas to said hollow chamber, driving the textile material to pass tensed through the system while controlling its tension using the tension compensators. The use of the tension compensators prevents the formation of ozone induced defects on the textile material.

33 Claims, 4 Drawing Sheets

(51) Int. Cl.

| | |
|---|---|
| ***D06B 3/04*** | (2006.01) |
| ***D06B 3/12*** | (2006.01) |
| ***D06B 3/18*** | (2006.01) |
| ***D06B 3/34*** | (2006.01) |
| ***D06B 23/02*** | (2006.01) |
| ***D06B 23/04*** | (2006.01) |
| ***D06B 23/18*** | (2006.01) |
| ***D06B 23/20*** | (2006.01) |
| ***D06B 3/36*** | (2006.01) |
| ***D06B 21/02*** | (2006.01) |
| ***D06F 33/50*** | (2020.01) |

(52) U.S. Cl.

CPC ..... *D06B 3/345* (2013.01); *D06B 3/36* (2013.01); *D06B 21/02* (2013.01); *D06B 23/023* (2013.01); *D06B 23/04* (2013.01); *D06B 23/18* (2013.01); *D06B 23/20* (2013.01); *D06F 33/50* (2020.02); *D06L 4/50* (2017.01); *D06B 2700/09* (2013.01)

(56) References Cited

U.S. PATENT DOCUMENTS

| | | | | |
|---|---|---|---|---|
| 6,408,471 | B1 * | 6/2002 | Teran | D06F 35/001 68/183 |
| 7,614,260 | B2 * | 11/2009 | Daniels | D06F 35/001 68/12.02 |
| 2008/0092601 | A1 * | 4/2008 | Konides | D06F 35/001 29/401.1 |
| 2012/0017379 | A1 * | 1/2012 | Moore | D06F 35/001 68/5 R |
| 2015/0308030 | A1 * | 10/2015 | Allen | D06L 4/10 8/111 |

FOREIGN PATENT DOCUMENTS

| | | | | |
|---|---|---|---|---|
| CN | 108978088 | A | 12/2018 | |
| DE | 1 499 109 | A1 | 10/1969 | |
| EP | 1518955 | A1 * | 3/2005 | D06B 11/0096 |
| ES | 2 423 529 | A1 | 9/2013 | |
| GB | 337 305 | A | 10/1930 | |
| GB | 387 668 | A | 2/1933 | |
| GB | 2 063 944 | A | 6/1981 | |
| KR | 2014 0104682 | A | 8/2014 | |
| NZ | 521592 | A | 10/2003 | |

OTHER PUBLICATIONS

Written Opinion of the International Searching Authority dated Sep. 16, 2019 in corresponding International application No. PCT/ES2019/070423; 10 pages.

International Preliminary Report on Patentability dated Dec. 9, 2020 in corresponding International application No. PCT/ES2019/070423; 66 pages.

* cited by examiner

SYSTEM AND METHOD FOR TREATING TEXTILE MATERIAL WITH OZONE

FIELD

The present invention relates to the field of textile, and more particularly, to the removal of floating color from textile materials and/or to inducing other effects on textile materials by exposing the latter to ozone gas. Specifically, the invention concerns the case of treating with ozone gas a textile material when the latter is being processed while being spread out and moves lengthwise. A first aspect of the invention is a system for processing the textile material, and a second aspect of the invention is a method for treating the textile material. The system is adapted to execute the method. The textile material can comprise any kind of known in the garment and textile industries materials, with non-limiting examples being cotton and wool. The textile material can be a fabric or an ensemble of non-weaved and non-bonded between them yarns.

BACKGROUND

Denim is a very popular clothing fabric at present, and denim clothing made of denim is welcomed by many people. The removal of a floating color of the denim is a very important process in the manufacturing process. At present, the floating color is usually removed by rinsing using a rinsing bath. Nevertheless, for removing the floating color from denim, and/or for discoloring denim or other textile materials, and for treating textile materials for achieving a wide range of finishing effects, it is often advantageous to treat said materials with ozone gas.

Treating textile materials with ozone gas is a technological concept well known and widely applied in the textile industry. Such treatment is known to serve various different purposes such as discoloring the textiles or changing their appearance and/or surface chemistry. This is possible due to the fact that ozone is a known strong oxidant that can react with the fibers of textiles. Therefore, a great number of prior art documents describe various inventions and scientific discoveries related to treating textile materials, such as textile materials and garments, with ozone gas. Two common variations of implementing such treatments are immersing the textile in a liquid containing dissolved therein ozone, or by exposing the textile in a gas atmosphere containing ozone gas at relatively high concentrations. In the second variation, the ozone gas can be more readily and easily controlled to be high, as compared to in the first variation. For this reason, the second variation is of great interest for the task of processing at an industrial level long textile materials wherein relatively high ozone concentrations need to be applied. The present invention relates to said second variation. Examples of types of textile materials mentioned in the relevant prior art are fabrics, such as denim fabrics, and yarns.

A prior art document that concerns the second variation is the patent with publication number ES2423529, which describes a system for treating a textile material. The system comprises a processing chamber, a textile-feeding port and a textile-discharging port for allowing respectively the continuous textile material to pass part-by-part through the interior of the main chamber which contains a gas atmosphere rich in ozone for treating the textile material passing through thereof. When the system is operated, said ports respectively contain pools of liquid which serve the purpose of wetting and washing the textile material as it enters and exits the system, and also serve the purpose of acting as physical barriers for preventing the toxic ozone gas from exiting the chamber and from being released to the environment, thus also allowing that the ozone gas concentration inside the chamber is not dissipated due to gas leaks. In that system however, the main chamber comprises rollers which are configured so that the textile material inside the chamber is loose forming bags that hang in between the rollers.

Another example of a relevant prior art document is patent application with publication number NZ521592A which describes a system that is similar to the previous one, with a main difference being that the textile material while being processed is supported on a conveyer belt (or similar means), which is porous so that gas can be injected though the belt and the textile material supported thereon.

Patent document with publication number GB337305 describes a process for the treatment of textile threads and fabrics with ozone wherein the moistened and uniformly moved material is subjected in a chamber to the action of ozone which is introduced in the chamber at a concentration of below 2 grams (grammes) per cubic meter of air, and preferably only at 0.2-0.4 grams.

The aforementioned documents, as well as various others, describe how certain parameters, namely the ozone gas concentration and the wet pickup of the textile material inside the chamber, can be controlled to be within certain ranges in order to facilitate the treatment of the textile material. Nevertheless, the inventors of the present application have observed that when applying the teachings of the prior art as such, a variety of defects are randomly formed on the textile material as a result of treating it with ozone gas. Examples of such defects are lines and spots having different color compared to the parts of the textile material surrounding them. Consequently, the textile material becomes aesthetically non-appealing. Moreover, the inventors have observed that even when great efforts are made towards accurately controlling the aforementioned parameters, non-consistent results are obtained when repeating the method or operating the system using the same parameters. Said problems and inconsistencies may impede the wider use of this technology in the textile industry, and also may impede its improvement towards making it compatible with processing the textile material at high speeds. Therefore, a technical solution is needed to solve the aforementioned technical problems.

SUMMARY

The purpose of the present invention is to provide a system and a method for treating a textile with ozone gas, for example, for removing floating color with ozone. Essentially, an object of the invention is providing a method for treating textile materials with ozone, and the present invention offers a solution for preventing the formation of ozone-induced defects on the textile material when the latter is passing through a chamber inside which the textile material is exposed to ozone gas, even when the concentration of the ozone gas is high and/or when the textile material is passing, meaning it is processed, at high speeds. The solution comprises using a tension compensator that is in contact with textile material inside the chamber, and prevents the formation of ozone induced defects by contributing to tensioning the textile material and controlling the tension of the textile material. It is noted that the textile material when passing through the chamber is not carried by a conveyer belt and the like, rather it passes through and is guided by rollers disposed within the chamber. By implementing said parts of the solution, the problems of how to prevent the formation of ozone induced defects on the textile material, and how to avoid inconsistencies in the ozone-induced effects on the textile material, even when processing/treating the textile material at high processing speeds, are solved. Another object of the present invention is to provide a system for treating textile with ozone gas, and an example of treating is removing floating color with ozone. Essentially, the purpose of the invention it its first aspect is to provide a system (physical device) for processing textile materials with ozone gas, and the system comprises a tension compensator and is adapted for implementing the method of the invention, and for solving the technical problems mentioned above. The system is a device, and the terms "device" and "system" herein mean the same thing, therefore they are used indistinctively.

The present invention in its first aspect is a system for treating a textile material with ozone gas, the system comprising:

- a hollow chamber comprising in its interior a plurality of guide rollers, the plurality of guide rollers being configured to contact and guide the textile material to pass, being lengthwise tensed and breadthwise spread out, through the hollow chamber;
- an ozone supply system that is an ozone generating device connected to the hollow chamber and configured to supply to the latter ozone gas at a desired concentration value;
- a textile-feeding port that is adjacent and connected to the hollow chamber, and comprises a first tank that is configured to contain a first pool of a first liquid preventing the leak of ozone through the textile-feeding port when the system is operated;
- a textile-discharging port that is adjacent and connected to the main chamber, and comprises a second tank that is configured to contain a second pool of a second liquid preventing the leak of ozone through the textile-discharging port when the system is operated;
- a plurality of driving rollers configured to drive the textile material to move through the system;

wherein the system is configured so that the textile material successively passes through the first pool, through the interior of the hollow chamber, and through the second pool, the system being characterized in that it comprises an ozone concentration monitoring sensor arranged in the hollow chamber and connected with a microprocessor system, the microprocessor system being connected with a control system of the ozone generating device for adjusting an ozone generating speed of said ozone generating device according to the desired ozone concentration value, said desired ozone concentration value being of between 2 g/Nm$^3$ and 150 g/Nm$^3$, and the hollow chamber comprises in its interior at least one tension compensator configured to control the tension of the textile material when the latter passes through the hollow chamber.

Optionally and preferably, the tension compensator comprises a contact part that is configured to contact the textile material and be movable along a geometrical line in between a corresponding first working position and a second working position, and control the tension of the passing textile material by deflecting the latter applying to it a deflection force of between 0.5 N and 400 N when the textile material along its length intersects said geometrical line. Herein, the phrase "when the textile material along its length intersects said geometrical line", can alternatively be written as "when the textile material in at least one point along its length intersects said geometrical line", and could alternatively be expressed as "when a line defined by the linear advancing movement of the textile material (in its longitudinal direction) intersects with said geometrical line".

Optionally and preferably the system further comprises

- first signal transmittance means;
- second signal transmittance means connected to at least one of the plurality of driving rollers, said at least one of the plurality of driving rollers being configured to receive instruction signals via the second signal transmittance means and change its rotational speed according to said instruction signals;
- a sensor that is connected to or is part of the at least one tension compensator, and is connected to said first signal transmittance means, and is configured to sense the actual position of the contact part of the at least one tension compensator and generate a corresponding feedback signal and transmit said feedback signal via said first signal transmittance means;
- a tension control unit, that optionally is part of the at least one tension compensator, and comprises a programmable microprocessor connected to the second signal transmittance means and to the first signal transmittance means, and the microprocessor is configured to receive the feedback signal and correlate it to the actual position of the contact part or the corresponding with said position actual value of the deflection force or actual value of the tension of the textile material, and is also configured to compare said actual position or actual value of the deflection force or of the tension to a programmed by the user of the system corresponding desired position or desired value of the deflection force or of the tension, and when said actual position or actual value does not correspond to said corresponding desired position or desired value of the deflection force or of the tension, the microprocessor is configured and programmed to calculate a desired rotational speed at which the at least one of the plurality of driving rollers must rotate in order for said actual position or actual value of the deflection force or of the tension to become equal to the corresponding desired position or desired value of the deflection force or of the tension, and generate an instruction signal corresponding to said desired rotational speed, and transmit said instruction signal via the second signal transmittance means.

The feedback and instruction signals can for example be electrical signals and the like, the first and second signal transmittance means can optionally be parts of the at least one tension compensator, and can for example be electrical wires and the like. The driving roller can comprise motors driving the rotation of the rollers and connected to said second signal transmittance means, and optionally comprise their own microprocessors which are configured and programmed to control the rotational speed of the motors and thus of the driving rollers.

When the deflection force is of between 0.5 N and 400 N, meaning that the deflection force has a value of between 0.5 N and 400 N, then the deflection force has a defect prevention value because the value of the deflection force is optimum for preventing the formation of ozone induced defects. Optionally and preferably, the deflection force is constantly of between 0.5 N and 400 N, and most preferably the value of the deflection force is constant or substantially constant.

It is noted that in the textile industry guide rollers, driving rollers, ozone supply systems (ozone generating devices) and tension compensators are known devices. The present invention teaches the use of a tension compensator inside the chamber in which the ozone treatment of the textile material takes place, and also teaches the preferred way via which the tension compensator achieves preventing the formation of ozone induced defects on the textile material. The tension compensator of the system controls the tension of the textile web by applying to the latter a deflection force which can also be considered as a load applied on the textile material tensioning it and keeping it in contact with the tension compensator and deflecting it from the path that the textile material would follow in the absence of the tension compensator. There are other factors influencing the tension of the textile material inside the chamber, examples of said factors are the weight of the textile material, friction of the textile material with the various components (e.g. rollers) which contact the textile material passing through the system, and any differences in the traction forces applied to textile material from the different driving rollers of the system. Said other factors often change uncontrollably during the operation of the system. In contrast, the tension compensator, which in one example is a dancer (dancer roller, dancer roller system), applies to the textile material a deflection force (a load) which is stable or changes controllably. Also, the tension compensator, and more specifically its part that contacts the textile material, is configured to be movable. As a result, when the other factors change in a way that contributes to pulling towards one direction the textile material and the tension compensator's contact part in contact with the textile material, then the contact part in contact with the textile material moves towards, or substantially towards, the same direction thus preventing said change of the other factors from resulting to over-tensioning (substantial over-tensioning) of the textile material. Likewise, when the other factors change in a way that that contributes to loosening the textile material and moving it in another direction away from the contact part, then then the contact part in contact with the textile material moves towards, or substantially towards, said another direction thus preventing said change of the other factors from resulting to loosening (substantial loosening) of the textile material. The deflection force/load applied from the tension compensator to the textile material, said force/load being opposing the reactionary force/load applied from the textile material to the tension compensator, is preferably measured by a sensor, such as a load cell, a potentiometer, an inclinometer, attached to or integrated in the tension compensator and designed to measure the position of the tension compensator, and preferably the position of the contact part. Preferably, the deflection force/load is perpendicular to a geometrical plane that is tangent to the center of the interface between the contact part and the textile material that contact each other. Most of said sensors measure directly the position of the contact part, and the deflection force (load) is calculated using a correlation function between said position and said force. Likewise, said sensors optionally comprise corresponding microprocessors which calculate the force/load and optionally communicate with a tension control unit also comprising a microprocessor. Said tension control unit optionally is configured for controlling the driving/rotation of appropriately configured driving rollers, thusly controlling the torque output of the driving roller, thusly further controlling and stabilizing the textile material's tension, as is commonly described in the prior art regarding the general use of tension compensators, such as dancers, in the textile industry. It is noted, that the aforementioned deflection force's defect prevention value of between 0.5 N and 400 N, which approximately corresponds to a load of between 0.05 kg and 40 kg, is important for preventing the formation of ozone induced defects. Optionally, the deflection force is of between 10 N and 200 N, or of between 1 N and 100 N. The hollow chamber is the chamber inside which the treatment of the textile material with the ozone gas essentially takes place. Preferably the hollow chamber and any of the system's components contained in the interior of the hollow chamber are made of materials that are not corroded by ozone gas, for example the walls of the hollow chamber can be made of stainless steel. The walls of the hollow chamber do not contain open holes or gaps or cracks that would allow toxic ozone gas to escape to the environment outside the system when the textile-feeding port and the textile-discharging port do not contain the respective pools of liquid. Nevertheless, the hollow chamber contains inlets/ports on which the ozone supply system, or other optional components can be connected to or adjusted in a manner that prevents said escape of the ozone gas to the environment. In addition, the hollow chamber optionally comprises at least one door which can close hermetically, and serves the purpose of offering access to the interior of the hollow chamber when the system is not in operation. Additionally, the hollow chamber optionally comprises at least one viewing window made of a transparent material such as glass for allowing inspection of the interior of the chamber when operating the system.

The ozone supply system is an ozone generating device that converts the oxygen of atmospheric air into ozone gas, and provides to the interior of the chamber the ozone gas or a gas which is rich in ozone. More preferably, the ozone generating device is a stand-alone unit located on the side or close to the hollow chamber, and is connected and passing ozone gas to the hollow chamber, and for example to at least one gas inlet fixed on a side wall of the hollow chamber, via appropriate tubing connected to the said gas inlet and to an air outlet nozzle of the ozone generating device via which the produced ozone exits the ozone generating device. The system comprises at least one ozone concentration monitoring sensor exposed to any area of the interior of the hollow chamber, of the ozone generating device and of the optional tubing in between the former two, for measuring thereof the concentration of the ozone gas to check whether the latter has the desired ozone concentration value, so that the ozone generating device or its connection to the hollow chamber can be properly adjusted during the operation of the system for the purpose of having said desired value. Said desired ozone concentration value is of between 2 $g/Nm^3$ and 150 $g/Nm^3$, because within this value range, prevention of the formation of defects using this system is facilitated, especially when the textile material and its lengthwise segment is moving through the chamber at a very high or at a very low linear speed. The first liquid and the second liquid are liquids, such as water, that are commonly used when treating textiles. These liquids optionally comprise additional substances serving various purposes such as controlling the efficacy and rate of the chemical reaction between the textile material and the ozone gas, and/or washing the textile material and its lengthwise segment just before the latter enters the hollow chamber or just after the lengthwise segment exits the hollow chamber. The most important effect of these liquids and the two pools formed by them, is that they act as liquid barriers which in combination with the other components and configuration of the system do not allow the ozone gas to exit the hollow chamber via the textile-discharging and -feeding ports. The first and the second liquid are supplied to the system, for example they are supplied manually. Optionally, the system comprises a liquid supply system connected to the first tank and/or the second tank, and configured to supply thereof the first liquid and/or the second liquid. The liquids can be supplied from outside the system directly to the tanks when the configuration of the ports is such so that the tanks are readily accessible by the user. Alternatively, the textile-feeding port and/or the textile-discharging ports respectively have a first and a second liquid inlet thereof via which the first and second liquid are supplied to the respective tanks thereof.

When the system is operated, the textile material is moving lengthwise passing through the system as described further above. Preferably, the linear speed at which the textile material, and thus each lengthwise segment (part) of it, travels through the system is constant during the operation. Nevertheless, it is contemplated the option that the linear speed varies during operation, so that different lengthwise segments are treated under different conditions which result to different final effects on the textile material, or so that the final effect on all parts of the textile material travelling through the hollow chamber is the same when there are temporal intentional or unintentional changes on the other processing parameters and the speed has to be adjusted for compensating for said changes. The textile material, or a lengthwise segment of it, passes through the system by pulling/driving the textile material by using an appropriate driving roller and components as is described further below. In all cases, certain types of rollers are disposed within the interior of the hollow chamber and the textile-feeding port and textile-textile-discharging port for ensuring that the textile material in contact with said certain types of rollers follows through the system a well-defined path and moves smoothly across said path. Preferably the dimensions of the system and its components are such that allow the textile material to pass through the system being breadthwise spread. Therefore, optionally and preferably the width of the main system and of each of the system's components through which the textile material passes, is larger than the width of the textile material. Likewise, preferably the length of each of the various rollers and components, such as the contact part of the tension compensator, in contact with the textile material is larger than the width of the textile material. Preferably the textile material treated by the system is breadthwise fully spread out when lengthwise passing and travelling/running through the system.

A lengthwise segment is a part of the textile material that enters, travels through, and exits the system as described above. The lengthwise segment has the same width and thickness as the textile material and has the length of a fraction of the length of the textile material.

In an optional, yet preferred, configuration of the system each of the first tank and second tank respectively contain therein an at least one first immersed roller and an at least one second immersed roller, which are immersed in the respective first and second pools when the system is operated. The at least one first immersed roller is configured to receive the textile material (a lengthwise segment) entering the first pool of liquid and redirect it to exit therefrom for moving towards the interior of the hollow chamber. Similarly, the at least one second immersed roller is configured to receive the textile material (a lengthwise segment) entering the second pool of liquid and redirect it to exit therefrom for moving towards outside the hollow chamber and the textile-discharging port. Each optional immersed roller optionally is a guide roller, and more precisely, an external guide roller meaning a guide roller located outside the hollow chamber.

When the textile material (a lengthwise segment) enters the interior of the hollow chamber it is guided within the latter by the plurality of guide rollers fixed within the hollow chamber. Preferably, each of the guide rollers is disposed so that the textile material becomes breadthwise fully in contact with a part of the external surface of the guide roller when the textile material (a lengthwise segment of it) is moving through said guiding roller. Moreover, preferably the guide rollers are fixed on one or more walls of the interior of the hollow chamber and/or on a fixing structure supported therefrom, and are disposed so that their rotational axis is perpendicular to the direction of the movement of the textile material and the lengthwise segment thereof.

Similarly, the at least one tension compensator is preferably fixed on one or more walls of the chamber and/or on a fixing structure supported therefrom. Preferably, any of the at least tension compensator is configured so that when during the operation of the system the deflection force applied by the tension compensator does not have a defect prevention value, then the tension compensator is automatically adjusted, meaning that its contact part is moved, so that the deflection force obtains a defect prevention value. Nevertheless, said adjustment may not be automatic but happen after intervention of the system's user, especially when the contact part has reached the aforementioned first and second working positions or has moved to outside the mentioned further above geometrical line concerning the displacement/movement of the tension compensator. The tension compensator, meaning its contact part, is movable so that the interface between the tension compensator and the textile material is movable with respect to an immobile reference point within the hollow chamber. When the deflection force has a defect prevention value then the formation of ozone induced defects on the treated textile material and its lengthwise segments inside the chamber is prevented. There must be at least one tension compensator in the hollow chamber, nevertheless, optionally and preferably there are two or more tension compensators disposed along the travel path followed by the textile material within the hollow chamber. It is noted that the textile material treated inside the hollow chamber is lengthwise continuous and moves along its length, therefore at any specific moment the length of the tensed textile material inside the hollow chamber is equal to the travel path at that specific moment. Preferably the tension compensator is configured so that it is not corroded or damaged easily by the ozone gas. For example, preferably the surface of the tension compensator which becomes exposed to ozone gas is made of stainless still and/or teflon and/or another material that is resistive to corrosion. When the tension compensator requires additional components connected therewith for operating properly, then the system comprises said additional components. Preferably, the tension compensator is configured so that the deflection force applied from the tension compensator to the passing textile material is substantially uniformly distributed across the interface in between said tension compensator and the passing textile material; for example, said uniform distribution is achieved by the contact part being a cylinder having a longitudinal parallel to the widthwise direction of the textile material and the length of the contact part is larger than the width of the textile material, and the textile material breadthwise contacts uniformly the contact part of the tension compensator.

For the purpose of monitoring or estimating the prevention of the ozone induced defects, optionally the system comprises at least one sensor and is configured to measure the deflection force. The sensor usually measures the deflection force by measuring a physical parameter correlated with the deflection force. Non limiting examples of such sensor is a pressure sensor, a load/weight sensor such a load cell, or an inclinometer being part or connected to the tension compensator and configured to measure/monitor the position of the contact part in contact with textile material. Other non-limiting examples are a tension meter disposed within the hollow chamber and configured to measure the tension of the textile material. Tension meters are known in the textile industry. A further non-limiting example of a sensor, is an optical sensor configured to measure the position of textile material or the tension compensator at or close to the region where the textile material is in contact and deflected by the tension compensator. The sensor is optionally calibrated to directly indicate the deflection force according to a correlation function between the parameter measured by the sensor and the deflection force associated with the position of the contact part and/or the textile material in contact with the contact part. As is customary in the textile industry, tension compensators usually have integrated sensors for measuring the load or pressure or force exerted by the textile material to the tension compensator and vice versa, therefore preferably the at least one tension compensator comprises an integrated sensor measuring the pressure or load or force exerted by the textile material onto the tension compensator. Optionally, any or each sensor is configured to generate an emergency signal when the deflection force does not have the defect prevention value, or when the value of a physical parameter correlated with the deflection force and measured by the sensor does not correspond to case that the deflection force has the defect prevention value. Optionally, a sensor such as a load cell being attached or integrated into the compensator, sensing the position of the tension compensator in contact with the textile material and being calibrated to correlate said position with the deflection force, measures the deflection force.

Optionally the system comprises at least one actuator, such as a motor or a hydraulic or a pneumatic or a mechanical or an electromechanical actuator, connected to a corresponding tension compensator and configured to push and move the contact part of the tension compensator across the aforementioned geometrical line and in between the first and second working positions. Preferably the actuator is part of the tension compensator, and for example is a motor. Optionally and preferably the actuator is connected and controlled by a tension control unit comprising a microprocessor connected to the sensor and is configured to receive from said sensor a feedback signal which is based on the value measured by the sensor. Most preferably, the actuator is configured to move the contact part of the tension compensator when the feedback signal indicates that the deflection force does not have a defect prevention value or that the correlated with said force physical parameter measured by the sensor does not correspond to a case where the deflection force has a defect prevention value. Preferably the feedback signal can be an electrical or a wirelessly transmitted radio signal (and the like). Preferably, any sensor or actuator comprises a corresponding microprocessor and is configured to be controlled by and/or generate electrical signals received by said tension control unit. Optionally, each microprocessor or the tension control unit is connected to and is configured to receive by and communicate electrical signals to other microprocessors or a central computer unit.

The guide rollers are in contact with the textile material, and thus contact any lengthwise segment of the textile material passing through the hollow chamber, keeping the textile material tensed across its length and defining its travel path within the hollow chamber, when the textile material (lengthwise segment) is inside and passing through the hollow chamber. Moreover, for the purpose of maximizing the use of the ozone gas when the system is operated, and for compensating for potential variations of the ozone gas concentration across the interior volume of the hollow chamber, optionally, the plurality of guide rollers comprises, or is divided into, at least two groups of guide rollers, each of a first group and a second group of the at least two groups has at least two guide rollers, the first group is fixed on an upper part of the hollow chamber and the second group is fixed on a lower part of the hollow chamber, the plurality of guide rollers being also configured to guide the textile material to pass through both the upper part and the lower part of the interior of the hollow chamber.

When the textile material (e.g. a lengthwise segment) passes through the first pool of liquid, it is wetted by the latter. The concentration of the liquid in the textile material affects the treatment by the ozone gas, and affects the prevention of the formation of ozone induced defects on the textile material. Therefore, optionally the plurality of driving rollers comprises a first Foulard-type roller (also known as Foulard roller, or Foulard) fixed inside the interior of the hollow chamber and next to the textile-feeding port, and is configured to contact with and receive the textile material exiting the textile-feeding port, and to squeeze out liquid from the textile material so that a wet pickup value of the latter when exiting the first Foulard-type roller is of between 30% and 90%. The wet pickup value is defined as (weight of the liquid absorbed on the textile material)/(weight of the textile material when dry)*100(%), wherein both of the aforementioned weights are measured in same weight units. The aforementioned range for the wet pickup value contributes to optimizing the prevention of formation of ozone induced defects on the textile material.

Similarly to above, optionally the plurality of driving rollers comprises a second Foulard-type roller fixed next to the textile-discharging port and outside the hollow chamber, and is configured to be in contact with and receive the textile material exiting the textile material-discharging port, and is also configured to squeeze out liquid from the textile material. The second Foulard-type roller serves the purpose of further stopping the reaction between the ozone and the textile material, thus further preventing the formation of ozone induced defects, because the liquid being squeezed out by the second Foulard-type roller may contain ozone gas trapped therein. Another way for removing the liquid from the textile material is by drying the latter. For this reason, optionally the system comprises a dryer unit configured to receive and dry the textile material exiting the textile-discharging port or the optional second Foulard-type roller. This drier unit can be of any of the types used in the textile industry in relation to other types of systems and processes.

The aforementioned optional Foulard-type rollers of the system can drive the movement of the textile material through the system because they grab, press and move the parts of the textile material passing through them. Therefore, each of the Foulard type rollers acts as a driving roller. Nevertheless, optionally and preferably the system has at least one driving roller dedicated to solely driving the motion/passing of the textile material. Most preferably, the plurality of driving rollers comprises at least one internal traction roller disposed in the interior of the hollow chamber, the at least one internal traction roller being configured to contact the textile material and drive it to pass through the hollow chamber. In another optional and most preferred case, the plurality of driving rollers comprises at least one external traction roller located outside the hollow chamber and configured to be in contact with the textile material and drive it so the textile part passes through the hollow chamber. The use and configuration of driving rollers, such as internal or external traction rollers, for driving textile materials are well known in the textile industry. For example, as is common in the textile industry, a driving roller comprises or is connected to a motor that comprises a rotatable shaft connected to and configured to rotate the cylindrical part of the roller in contact with the textile material. It is important to note that subtle or larger changes in the rotational speed of any of the aforementioned rollers that function as a driving roller, can affect the tension of the textile material and thus the forces between the textile material and the tension compensator, and thus affect the prevention of the formation of ozone induced defects, when the system is operated. For this reason, optionally any of the plurality of driving rollers is configured so that its rotational speed is adjustable so that the deflection force has the defect prevention value. More preferably, the driving roller (or the motor driving the driving roller) comprises a microprocessor configured to control the rotational speed of the driving roller (or of the motor driving the driving roller), and said controller is connected to the microprocessor of one of said sensors or to a central computer connected to said one sensor, and is configured to change/adjust the rotational speed of the driving roller (or of the motor driving the driving roller) when the sensor generates the aforementioned emergency signal. Moreover, optionally the plurality of driving rollers is configured to drive the textile material to move/pass through the hollow chamber at a linear speed of between 5 m/min and 140 m/min; obviously, each of the plurality of the driving rollers contributes to said linear speed by rotating at an appropriate rotational speed. When the linear speed is of between the aforementioned values, then the productivity of the system is high and thus compatible with the needs of the textile industry, and also a uniform treatment of the textile is achieved with the formation of defects being prevented, because the textile material passes sufficiently fast with the mechanical forces applied on the textile material's fibers being uniformly controlled along the various parts of the textile material's travel path inside the chamber, without said textile material and fibers being affected by possible small variations in the ozone concentration along said path. Moreover, at the aforementioned linear speed range, the wet pickup value of the textile material (lengthwise segment) does not change significantly inside the hollow chamber, and thus a better control over the prevention of ozone induced defects is achieved.

The system optionally comprises an ozone gas destruction unit connected to the hollow chamber and/or to the ozone supply system, and configured to extract and destroy the ozone gas from the interior of the hollow chamber and/or from the ozone supply system. This unit can be the same or similar to the ozone gas destruction units which are known and are widely used in the textile industry. In accordance to the customary practice, the ozone gas destruction unit may optionally comprise one or more pumps to suck gas from the hollow chamber and/or from the ozone generating device and/or from any tubing there in between. The ozone gas destruction unit serves the purpose of destructing ozone before the system is turned off so that a user can subsequently open safely the system, and also serve the purpose of removing the ozone from the chamber when a malfunction in the normal operation and components of the system is detected, and an emergency shutdown of the system is necessary for protecting the user and for preventing the formation of defects on the processed textile material.

The system and the technical effects produced by it are optimized when the first and second liquids contained respectively in the first and second tank when the system is operated, are replenished or replaced constantly or within certain time intervals. During the operation of the system, said liquids may be contaminated by ozone gas and/or dust and/or other chemical impurities, which will then affect the textile material and its treatment, because the textile material is wetted by said liquids. Moreover, the textile material when processed by the system may leave as deposits fibers or other substances in the liquids, and said deposits may be re-passed to the textile material, negatively affecting the textile material's quality and promoting the formation of ozone induced defects. To avoid the latter problem, optionally the system further comprises a liquid purification unit connected to the first tank and/or the second tank and configured to receive liquid therefrom, and to remove from said liquid ozone, fibers released by the textile material, and chemical byproducts produced by the treatment of the textile material and passed to the liquid. Optionally, the first and second tanks respectively have a first and a second liquid outlets fixed thereon, and the liquid purification unit is connected to these outlets. Liquid purification units are known and widely used in the textile industry in other types of systems.

The aforementioned system components and ranges for the linear speed and ozone concentration related to the best operation and configuration of the system, result to optimum treatment of the textile material and prevention of the formation of defects, when each part of the textile passing through the hollow chamber follows a path of at least 10 m in length inside the hollow chamber. This path is determined by the dimensions of the hollow chamber and the spatial configuration of its components, which are in contact and guide the passage of the textile material (lengthwise segment). Therefore, optionally the hollow chamber is configured so that the textile material follows a travel path of a length of at least 10 m inside the hollow chamber. The performance of the system is further optimized, especially when the system is used for treating elastic textile materials such an as elastic denim fabric, when optionally each of the guide rollers of the plurality of guide rollers has a diameter of an optimum, for preventing ozone induced defects on the textile material, value of between 50 mm and 500 mm. In that case, the guide rollers can keep the textile material uniformly tensed across its length and width. This effect is further enhanced in the optional case, wherein each two consecutive guide rollers along the travel path that the textile material follows inside the hollow chamber, are disposed so that the length of the travel path's part in between said consecutive guide rollers is of an optimum, for preventing ozone induced defects, value of between 20 cm and 200 cm, and preferably of between 60 cm and 90 cm.

The system is very well suited for using it for treating with ozone gas the textile material after the latter is dyed. For this type of use, the prevention of the formation of ozone induced defects is optimized when the ozone treatment by the system is done soon after the textile material is dyed. For this reason, optionally the system further comprises at least one dyeing unit located outside the hollow chamber and the textile-feeding and receiving ports and configured to dye the textile material. Optionally and preferably, the dyeing unit is located next to the textile-feeding port and is configured to pass the textile material to the textile-feeding port. Likewise, the system is very well suited for using it for treating with ozone gas the textile material before the latter is dyed. In that case, the uniform and defect-free ozone treatment of the textile material by the system, can increase the dye uptake of the textile material during the dyeing process, and promote the uniform dyeing of the textile material, especially when the ozone treatment happens just before the dyeing treatment. For this reason, optionally the system comprises at least one dyeing unit located next to the textile-discharging port and configured to receive the textile material from the textile-discharging port and dye it. The dyeing unit may comprise washing subunits which are configured for washing the lengthwise segments of the textile before or after said lengthwise segments are dyed.

It is contemplated the case of using the system for processing with it a textile material that is originally folded, for example rolled into a roll, or is directly supplied to the system by another textile processing machine. For this reason, optionally the system further comprises an unfolding unit configured for unfolding and/or unrolling the textile material and passing the unfolded textile material to the textile-feeding port. Likewise, optionally the system comprises a first accumulation unit, for example a J-box, which is configured to receive and at least partially accumulate the textile material and pass the latter to the textile-feeding port. Likewise, it may be desirable that the ozone treated textile material or lengthwise segment thereof to be accumulated and/or rolled after the ozone treatment. Therefore, optionally the system further comprises a second accumulation unit, for example a J-box with optionally a roller attached to it, configured to receive, at least partially accumulate, and optionally roll the lengthwise segment exiting the textile-discharging port or the optional second Foulard-type roller.

As mentioned, the textile material can be a fabric, or can be an ensemble of yarns meaning non-weaved and non-bonded between them yarns. Preferably said ensemble has the width and height of a fabric, and along said width the yarns are uniformly distributed. When processing this type of textile material, it has been found by the inventors that the prevention of the formation of defects on the textile material and the yarns contained therein and processed by the system, is optimized when the yarns of the lengthwise segment of the textile material do not contact the full cylindrical external surface of each of the guide rollers. Then the surface of each yarn is homogenously exposed to the ozone gas and the effect produced by the tension compensator in combination to the guide rollers is maximized. For this reason, it is contemplated the optional variation of the system each of the guide rollers of the plurality of guide rollers comprises fins configured to reduce the contact area between the textile material (lengthwise segment of the textile material) and the guide rollers. The textile material is not part of the system, and the option that each of the guide rollers comprises fins is mostly contemplated for the case that the system is intended to be used for processing a textile material comprising non-weaved yarns. In that case, it is contemplated that the yarns of the web are being fed to the textile-feeding port as being substantially parallel and non-weaved or entangled or bonded with each other, and the yarns contact the top edges of the fins of each one of the guide roller when the textile material (lengthwise segment) passes through the guide roller. In the textile industry there are various known types of guide rollers comprising fins for processing textile materials comprising non-weaved non-bonded yarns, and the system can for example comprise known types of guide rollers comprising fins. Preferably the longitudinal axis of the fins is parallel to the rotational axis of the guide roller.

Likewise, when the fabric is a textile material comprising yarns, meaning non-weaved and non-bonded between them yarns, the parts of the yarns of the textile material, and thus of any lengthwise segment, that are located in between the guide rollers of the plurality of guide rollers, may contact or be very close to each other. This is not desired, because it may result to an inhomogeneous ozone treatment of each yarn and may trigger the formation of ozone induced defects. To solve the problem of preventing the formation of ozone induced defects on the textile material when the latter comprises yarns (meaning non-weaved non-bonded between them yarns), optionally the hollow chamber in its interior and in between at least two of the guide rollers of the plurality of guide rollers, comprises at least one separator configured to spatially separate at its vicinity a first set of the yarns of the textile material from a second set of the yarns of the textile material. For example, when the textile material passes next or in contact to the separator, the first set of yarns of the textile material pass over or contact one side of the separator, and the second set of the yarns pass over or contact the other side of the separator, thus being spatially separated from the yarns of the first set. In a non-limiting example, the at least one separator is a cylinder fixed inside the chamber with its longitudinal axis being perpendicular to the travel path of the textile material at the vicinity of said separator. In an additional optional case, said separator also comprises fins. In this case "vicinity" means a distance of a few centimeters, for example a distance up to 30 cm or up to 10 cm from the separator.

In an exemplary embodiment of the present invention, hereafter called the "exemplary embodiment", the aforementioned system is:

a device for removing floating color with ozone, comprising a hollow chamber, wherein a left side wall of the hollow chamber is provided with a textile-feeding port, and a right side wall of the hollow chamber is provided with a textile-discharging port;

the hollow chamber is internally provided with guide rollers for changing a moving direction of denim, the guide rollers are divided into two groups depending on their positions, each of the two groups have at least two guide rollers, one group is fixed on an upper part of the hollow chamber and the other group may be fixed on a lower part of the hollow chamber;

a driving roller for driving the denim to move from left to right is fixed above the textile-discharging port through a support, and a rotating shaft of the driving roller is connected with a rotating shaft of a driving motor through a transmission mechanism; and an air inlet is arranged in the hollow chamber, the air inlet is communicated with an air outlet port of an air intake pipe, and an air inlet port of the air intake pipe is communicated with an air outlet nozzle of an ozone generating device, the system being characterized in that the hollow chamber comprises in its interior at least one tension compensator configured to control the tension of the textile material when the latter passes through the system and contacts the tension compensator.

In the exemplary embodiment optionally and preferably the tension compensator of the exemplary embodiment comprises a contact part that is configured to contact the textile material and be movable along a geometrical line in between a corresponding first working position and a second working position, and control the tension of the passing textile material by deflecting the latter applying to it a deflection force of between 0.5 N and 400 N when the textile material along its length intersects said geometrical line.

All the herein described optional (or preferable) features and parameters of the system of the first aspect of the invention are also optional (or preferable) features of the exemplary embodiment, and vice versa. In the exemplary embodiment the driving roller drives the textile tensioned on the guide roller to move from left to right, and meanwhile, the ozone generating device generates ozone and delivers ozone to the hollow chamber. Optionally, the driving roller also drives the textile material to move from right to left.

In the exemplary embodiment the hollow chamber is preferably made of stainless steel, and the hollow chamber is optionally and preferably of 4 m*1.1 m*2.5 m (length*height*width). The length of the textile in the hollow chamber is optionally and preferably 50 m±5 m, so as to adapt to a concentration of ozone.

In the exemplary embodiment optionally and preferably, the upper part of the hollow chamber is sealed, the hollow chamber is provided with the textile-feeding port, the textile-discharging port, the air inlet and the air outlet, in which the air outlet is communicated with an air inlet port of an air outlet pipe.

In the exemplary embodiment optionally and preferably, the textile-feeding port and the textile-discharging port are both provided with a sealing structure for preventing ozone from overflowing therefrom. Please note that the sealing structure can be used to reduce, but not completely eradicate, the leakage of ozone.

In the exemplary embodiment optionally and preferably, the sealing structure comprises a first partition plate, the top part of the first partition plate being abutted against the top of the hollow chamber, and a gap is arranged between the bottom part of the first partition plate and the bottom of the hollow chamber;

the sealing structure optionally further comprises a second partition plate, the bottom part of the second partition plate being abutted against the bottom of the hollow chamber, and a gap is arranged between the top part of the second partition plate and the top part of the hollow chamber;

optionally, the first partition plate is located between a side wall of the hollow chamber and the second partition plate, and the height at which the bottom of the first partition plate locates is lower than the height at which the top part of the second partition plate locates;

optionally, water is filled between the side wall and the first partition plate, and between the first partition plate and the second partition plate, and the height at which the water level of the water locates is lower than the height at which the top part of the second partition plate locates, but higher than the height at which the bottom of the first partition plate locates;

optionally two of the guide rollers which are fixed at the lower part of the hollow chamber may be located in the water; and optionally the textile-feeding port and the textile-discharging port are opened on the side wall of the hollow chamber outside the first partition plate.

According to the present invention, in the exemplary embodiment the structure of the hollow chamber is optimized, when uses the partition plate and the side wall to form a water sealing structure which can effectively prevent the overflow of ozone and reduce the entry of water into the hollow part inside the second partition plate. Certainly, other liquids can be used to replace water to realize the sealing.

In the exemplary embodiment optionally and preferably, the air inlet is located at the top of the hollow chamber inside the first partition plate, and also can further be located in the bottom or the side wall of the hollow chamber inside the second partition plate.

In the exemplary embodiment optionally and preferably, the air inlet is provided with a three-way valve, one valve port of the three-way valve is communicated with the hollow chamber, one valve port is communicated with the air outlet port of the air intake pipe, one valve port is communicated with the air outlet port of an air guide pipe. Optionally, the air inlet port of the air guide pipe is connected with an air outlet of an air blower. In this way, the air pressure at the air inlet can be increased by means of the air blower, thereby increasing the action intensity of ozone with the denim (or other textile), and improving the effect of treating with ozone, and for example the effect of removing the floating color.

In the exemplary embodiment optionally and preferably, the air intake pipe is provided with a flow valve, which is used to adjust an inflating volume of ozone, so as to control the ozone amount in the hollow chamber.

In the exemplary embodiment optionally an ozone concentration monitoring sensor is arranged in the hollow chamber, and is connected with a microprocessor system. The microprocessor system is connected with a control system for the ozone generating device, which adjusts the ozone generating speed according to the concentration of ozone, so as to control the ozone amount in the hollow chamber.

The ozone generating device can be directly purchased at the market, and the ozone-generating structure and its operational principles belong to the prior art, and will not be described in detail herein. The present invention does not intend to provide a new ozone generating device.

In the exemplary embodiment, the device for removing floating color with ozone optionally further comprises at least two rinsing baths (pools of liquid), in which at least one may locate on a left side of the hollow chamber and at least one may locate on a right side of the hollow chamber;

a driving roller for driving the denim to move from left to right is optionally arranged above the discharge port of the rinsing bath, and a rotating shaft of the driving roller is optionally connected with a rotating shaft of a driving motor through a transmission mechanism;

the rinsing bath is optionally filled with water, and the guide roller for changing a moving direction of the denim is optionally provided inside the water in the rinsing bath; and by means of the driving motor, the denim (textile material) is driven to sequentially pass through the guide roller of the rinsing bath located in front of the hollow chamber, the driving roller of the rinsing bath located in front of the hollow chamber, the guide roller of the hollow chamber, the driving roller of the hollow chamber, the guide roller of the rinsing bath located behind the hollow chamber, and the driving roller of the rinsing bath located in front of the hollow chamber.

In the exemplary embodiment optionally, the rinsing bath preferably comprises a cavity opened upwards, and the side wall of the cavity is provided with the water inlet and the water outlet;

the water inlet is connected with the water inlet pipe, and the water outlet port of the water inlet pipe is communicated with the cavity; and the water outlet is connected with the water outlet pipe, and the water inlet port of the water outlet pipe is communicated with the cavity. Preferably, the water inlet and the water outlet in the cavity are used for realizing the circulation and renewal of the water in the rinsing bath.

In the exemplary embodiment preferably, two rinsing baths (pools) are arranged, in which one is located on the left side of the hollow chamber and the other is located on the right side of the hollow chamber. Optionally, water flowing out relative to the rear of the hollow chamber can be used as water flowing in relative to the front of the hollow chamber to improve the utilization rate of water. Thus, the water outlet of the rinsing bath which locates at the relative rear can be connected, through a pipeline, with the water inlet of the rinsing bath which locates at the relative front, and a water pump for driving water to flow may be arranged on the pipeline.

A method for removing floating color with ozone is characterized by performing an oxidation reaction of ozone with the floating color on a textile by means of strong oxidation property of ozone, to separate the floating color from the textile.

Said method is a method for treating a textile material with ozone gas.

Thus the invention in its second aspect is a method for treating a textile material with ozone gas, the textile material being a fabric or an ensemble of non-weaved and non-bonded between them yarns, the method comprising the steps of:

providing a first liquid to a first tank and a second liquid to a second tank of a system that is according to the first aspect of the invention;

supplying the hollow chamber of the system with ozone gas at a desired ozone concentration value, by using the ozone generating device of the system;

passing the textile material tensed through the system, by using the plurality of driving rollers and the plurality of guide rollers of the system;

the method being characterized in that the desired ozone concentration value is of between 2 g/Nm$^3$ and 150 g/Nm$^3$, and during the third step controlling the tension of the textile material inside the hollow chamber by using the tension compensator of the system.

Optionally and preferably, in the system used for executing the method, the tension compensator comprises a contact part that is configured to contact the textile material, and be movable along a geometrical line in between a corresponding first working position and a second working position, and control the tension of the passing textile material by deflecting the latter applying to it a deflection force of between 0.5 N and 400 N when the textile material along its length intersects said geometrical line, and in the third step of the method controlling the tension of the textile material comprises applying to the textile material the deflection force of between 0.5 N and 400 N using the tension compensator (meaning using the contact part). Obviously, the contact part can be positioned at any point along said geometrical line, and applies said force of said defect prevention value when is positioned any point along said geometrical line.

Preferably, the deflection force being applied on the textile material is constantly of between 0.5 N and 400 N, and optionally the value of the deflection force is constant or substantially constant.

The first step of the method can be also described as follows: providing a first liquid to a first tank, and providing a second liquid to a second tank, in a system that is according to the first aspect of the invention.

The desired ozone concentration value is of between 2 g/Nm$^3$ and 150 g/Nm$^3$, and for example is of between 2 g/Nm$^3$ and 30 g/Nm$^3$, or is of between 25 g/Nm$^3$ and 150 g/Nm$^3$. Alternatively, the concentration of ozone in air in the chamber is of between 5% and 15%, and preferably is 10%. It is noted that the aforementioned values regarding the ozone concentration in air, and the aforementioned desired ozone concentration values, are measurable by commercially available ozone concentration sensors and analyzers, such as the Model 452 process ozone by Teledyne Instruments, and the UV-HCR Ozone Analyzer by Oxidation Technologies, LLC. Obviously the above method entails the action of spreading out the textile material across the system contacting the textile material with the rollers and the tension compensator, and this preferably and optionally can be done during any of the method's steps, but preferably is done during/in or before the first step of the method, or during/in the third step. It must also be understood that passing the textile material during the third step implies operating the system and as such, utilizing its components and its configuration for guiding and driving the textile material across the system's various components, such as the guide rollers, which are destined to contact and guide the passage of the textile material. One alternative non-preferable way of passing/driving the textile material is to manually pull the textile material from outside the textile material-discharging port. Preferably, the third step of the method comprises, adjusting the rotational speed of at least one driving roller to tense the textile material so that the material passes through a region (e.g. through the aforementioned geometrical line) inside which the tension compensator can contact the textile material and is capable of controlling the tension, and for example applies the deflection force of the defect prevention value as described above. Since the textile material's wet pickup value can affect critically the ozone treatment and the prevention of the formation of defects, when the system comprises the First Foulard type roller as described further above, then optionally the third step of the method comprises squeezing out liquid from the textile material by using the first Foulard-type roller thusly, adjusting the wet pickup value of the textile material when exiting the first Foulard-type roller to be of between 30% and 90%. In that optional case and when necessary, the method further comprises adjusting the First Foulard type to squeeze the textile material for achieving the aforementioned wet pickup value.

Optionally, during its third step the method comprises guiding the textile material to pass through both the upper part and the lower part of the interior of the hollow chamber. The latter option requires the use of the mentioned further above system's optional feature that the guide rollers of the plurality of guide rollers are configured so that the textile material passes through both the upper and the lower part of the hollow chamber. Moreover, it is contemplated the option of passing the textile material through the hollow chamber at a linear speed of between 5 m/min and 140 m/min, and for example of between 25 m/min and 50 m/min, or of between 50 m/min and 140 m/min, in the third step of the method.

Optionally and with the proviso that the system has the sensor mentioned further above, it is contemplated the option of, during the third step of the method, using the least one sensor for measuring the value of the deflection force and/or of the physical parameter correlated with the deflection force. It is further preferable that the system comprises an electromechanical actuator as described above and during the third step of the method using the value measured by the at least one sensor as a feedback signal for adjusting the position of the contact part of the tension compensator using said electromechanical actuator. That way the task of ensuring that the deflection force has the prevention value is facilitated.

When the system comprises the second Foulard type roller as described above, then it is preferable, during the third step of the method, squeezing out liquid from the textile material using the second Foulard-type roller.

As mentioned the system is exceptionally well suited for treating the textile material with ozone just before or just after the textile material or parts of it are dyed. For this reason, optionally the method comprises dyeing the textile material. Preferably dying is done before or after the aforementioned third step of the method. Said dying can be implemented by using a system comprising the aforementioned dyeing unit.

The method can be implemented when the textile material is fabric, or when the textile material comprises non-weaved and non-bonded between them yarns. In the latter case, and with the proviso that in the system used for implementing the method each of the guide rollers has fins, optionally the method's third step further comprises using the fins of the guide rollers to reduce the contact area between the textile material and the guide rollers. Nevertheless, the use of guide rollers comprising fins can also be implemented for treating a fabric.

In relation to preventing the formation of ozone induced defects on the textile material, it is preferable that during the third step of the method to be passing the textile material at a high linear speed when the ozone concentration value is relatively low, and to be passing the web speed at low linear speed when the ozone concentration value is relatively high. For this reason, it is disclosed the optional case that, when the desired ozone concentration value is of between 2 g/Nm$^3$ and 15 g/Nm$^3$, then during/in the third step of the method passing the textile material through the hollow chamber at a linear speed of between 25 m/min and 50 m/min. Similarly, it is also disclosed the optional case that, when the desired ozone concentration value is of between 10 g/Nm$^3$ and 150 g/Nm$^3$, then during/in the third step of the method passing the textile material through the hollow chamber at a linear speed of between 20 m/min and 150 m/min. Similarly, it is also disclosed the optional case, that the desired ozone concentration value is of between 5 g/Nm$^3$ and 30 g/Nm$^3$, and during/in the third step of the method passing the textile material through the hollow chamber at a linear speed of between 25 m/min and 50 m/min.

Also in relation to preventing the formation of ozone induced defects on the textile material, it is desirable adjusting the ozone concentration speed and linear value taking into account the length of the travel path along which the textile material is passing inside the hollow chamber and also taking into account whether the textile material, and thus also the textile material, is a fabric or it comprises separated from each other yarns. For this reason, there are disclosed the following optional cases: i) the textile material is a denim fabric, the hollow chamber (13) is configured so that therein the textile material follows a travel path of a length of between 10 m and 35 m, the desired ozone concentration value is of between 2 g/Nm$^3$ and 30 g/Nm$^3$, and in the third step of the method passing the textile material through the hollow chamber (13) at a linear speed of between 25 m/min and 50 m/min, ii) the textile material is a denim fabric, the hollow chamber (13) is configured so that inside it the textile material follows a travel path of a length of between 10 m and 35 m, the desired ozone concentration value is of between 25 g/Nm$^3$ and 150 g/Nm$^3$, and in the third step of the method passing the textile material through the hollow chamber (13) at a linear speed of between 50 m/min and 140 m/min.

Also in relation to preventing the formation of ozone induced defects on the textile material, preferably the method also comprises adjusting the ozone concentration value and the textile material's linear speed according to the type of the textile material. For this reason, there are also disclosed the following optional cases: i) the textile material is denim fabric dyed with indigo, reactive and/or Sulphur dyes, the desired ozone concentration value is of between 2 g/Nm$^3$ and 15 g/Nm$^3$, and in the third step of the method passing the textile material through the hollow chamber at a linear speed of between 25 m/min and 50 m/min, ii) the textile material is fabric that is raw and/or in greige state, the desired ozone concentration value is 20 g/Nm$^3$, and in (during) the third step of the method passing the textile material through the hollow chamber at a linear speed of 40 m/min, iii) the textile comprises wool, the desired ozone concentration value is of between 15 g/Nm$^3$ and 30 g/Nm$^3$, and during the third step of the method passing the textile material through the hollow chamber at a linear speed of between 25 m/min and 50 m/min.

Due to the present invention's inventive concept that is directed to solving the problem of preventing the formation of ozone induced defects on the textile material, a large variety of types of textile materials can be processed using the system and the method of the present invention. Moreover, by preventing the formation of said defects, the various described herein physical parameters related to implementing the invention, can be varied for achieving various finishing effects on the textile material, without the latter suffering from said defects. Therefore, the present invention is for treating the textile material, wherein treating the textile material can be understood, in a non-limiting way, as being any of the following finishing effects—shining the textile material, removing backstaining from the textile material, washing the textile material, bleaching the textile material, discoloring the textile material, regulating the pH of the textile material, fixing sulfur dyeing of the textile material, oxidizing a dye adsorbed on the textile material, whitening the textile material, preparing the textile material for dyeing, improving the subsequent uptake of dyes or pigments or colorants or resins or enzymes by the textile material, improving crocking of the textile material, improving anti-aging performance of the textile material, removing floating color from the textile material, mercerizing the textile material, desizing the textile material, preventing shrinkage of the textile material.

Without wishing to be bound to any specific theory, the inventors in view of the unexpectedly good prevention of the formation of ozone induced defects on the textile material by implementing the present invention, suggest that the dynamics of the reaction of the ozone gas with the textile material depend, at least to some extent, to the tension of the textile material inside the chamber, and vice versa. The inventors suggest that the exact mechanical state, such as the tension, of the fibers of the textile material must be controlled when exposing the fibers to the ozone gas. For this reason, the use of at least one tension compensator inside the ozone containing hollow chamber solves the problem of how to prevent the formation of ozone induced defects. Moreover, given the complexity of the system and method, and given the fact that the ozone treatment takes place inside the hollow chamber, the inventors believe that it is important to have said tension compensator inside the hollow chamber where the reaction takes place. Of course, optionally the system can also comprise tension controllers such as tension compensators located outside the hollow chamber.

BRIEF DESCRIPTION OF THE DRAWINGS

The previous and other advantages and features will be more fully understood from the following detailed description of embodiments, with reference to the attached figures (drawings), which must be considered in an illustrative and non-limiting manner, in which.

DETAILED DESCRIPTION OF THE EMBODIMENTS

Figure 1:
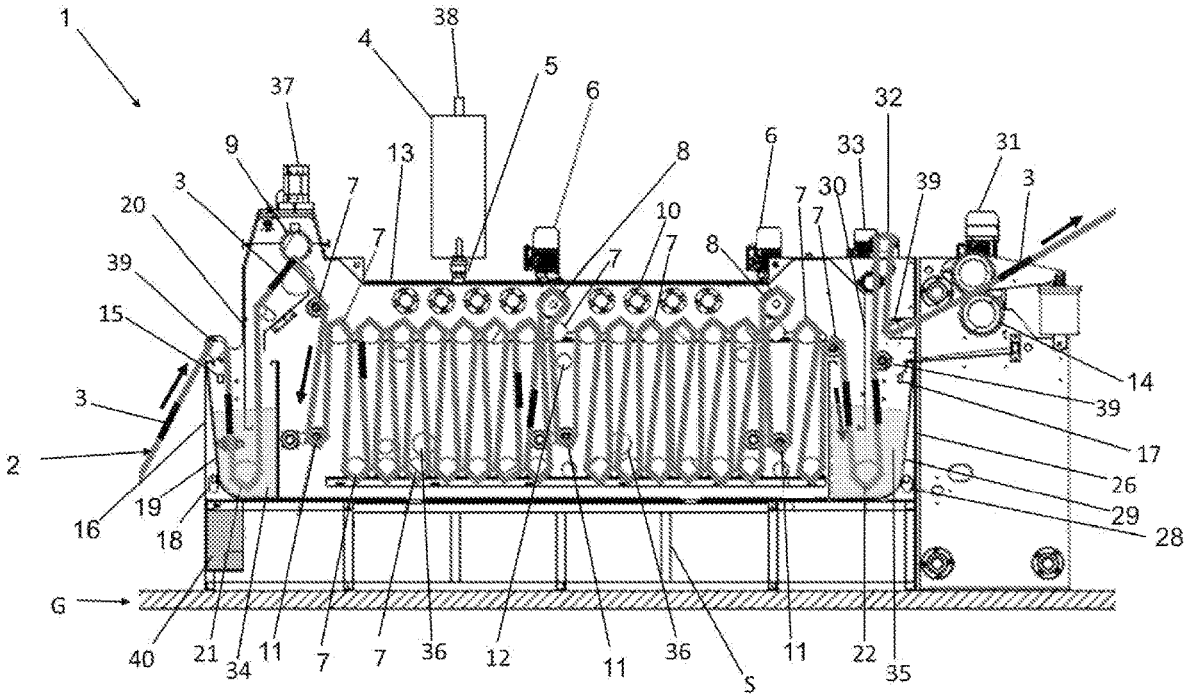
FIG. 1 is a schematic diagram of a cross section of a first preferred embodiment of the system when the latter operated.

FIG. 1 shows a first preferred embodiment of the system of the first aspect of the invention. In this case the system 1 is positioned on the ground G, and comprises the hollow chamber 13, the textile-feeding port 16 which is adjacent and connected, e.g. via the system's side walls (not fully shown), to the to a first wall 20 of the hollow chamber 13. The system 1 also comprises the textile-discharging port 26 which is adjacent and connected to a second wall 30 of the hollow chamber. Said textile-feeding port 16 comprises the first tank 19, the first liquid inlet 15, the first liquid outlet 18 which is connectable to a liquid purification unit (not shown), and the first immersed roller 21, and the external textile redirection mean 39 which in this case is a bar. Said textile-discharging port 26 comprises the second tank 29, the second liquid inlet 17, the second immersed roller 22, and the second liquid outlet which is connectable to said liquid purification unit. The first and second liquid inlets 15, 17 are connectable to a liquid supply system (not shown). In this embodiment, the system 1 also comprises a support structure S which holds above the ground the hollow chamber 13 and the textile-discharging and feeding ports 26, 16. In this particular case, the ozone supply system is an ozone generating device 40 (rectangle highlighted by gray color) located below the textile-feeding port 16, and is connected via tubing (not shown) to eight gas inlets 10 (air inlets) fixed on the back side wall of the hollow chamber 13. When the system is supplied with the first and a second liquid for being operated, the indicated by the light gray color first pool 34 and second pool 35 are formed respectively so that the lower edges of the first and the second walls 20, 30 are fully immersed inside the respective pools 34 and 35. Similarly to the prior art, in this embodiment each of the front- and the back- (with respect to the plane of the drawing) side walls of the hollow chamber extends towards the first tank 19 and the second tank 29 acting as corresponding side wall thereof, and also being united to the entire length of the front and back side edges (not shown) of said first wall 20 and said second wall 30. For this reason, ozone gas in the hollow chamber cannot escape through the textile material-feeding and discharging ports 16, 26 when the first and the second pools 34, 35 are respectively present. The hollow chamber 13 also comprises a plurality of guide rollers 7 (for clarity of presentation not all guide rollers are numerically indicated, the reader can distinguish them in the drawing), two internal traction rollers 8 with each being drivable by a corresponding traction motor 6 properly connected to the former and located on top of the hollow chamber, and three tension compensators 11. The system 1 further comprises the first Foulard-type roller 9 which is drivable by a properly connected therewith first drive motor 37 located on top of the hollow chamber 13 close to the textile-feeding port 16, and the system 1 also comprises the second Foulard-type roller 14 which is drivable by a properly connected therewith second drive motor 31 located on top of the former. In this case, as is obvious from FIG. 1, each of the first and the second Foulard-type rollers 9, 14 comprises a set of two respective sub-rollers (not indicated numerically) and the distance between the sub-rollers of each set is adjustable so that the pressure applied to the textile material 2 and its lengthwise segments 3 passing in between said sub rollers is also adjustable so that the amount of liquid removed from the textile material 2 and thus the wet pickup value of the latter (e.g. of a lengthwise segment 3) when leaving each Foulard-type roller, is controlled. The system 1 also comprises another driving roller, that is an external traction roller 32, located outside the hollow chamber 1 and above the second tank 29 and pool 35, said external traction roller 32 being connected and drivable by the external drive motor 33 located close to the former. Left to the second Foulard-type roller the system 1 also comprises the external textile redirection mean 39 which is an external guide roller. Overall, the system's external textile redirection means 39, being external guide rollers and/or bars and configured to guide the textile material 2, and thus its lengthwise segments 3, to enter the textile-feeding port 16 and exit the textile-discharging port at the appropriate directions for passing through the system and its rollers. In FIG. 1, the textile material 2 being lengthwise spread out across and passing through the system when the latter is used, is depicted by the thick gray line. Examples of the lengthwise segments 3 of the textile material 1 are depicted by the thick black lines overlaid on the thick gray line depicting the textile material 2. The direction of movement of the textile material 2, and thus of each lengthwise segment 3, across various parts of the textile material's travel path is indicated by the thick black arrows. The hollow chamber 13 of the system 1 also comprises ozone concentration monitoring sensors 12 which are connectable to the microprocessor system of a gas analyzer (not shown) and are configured to measure the ozone gas concentration inside the hollow chamber when the system is operated. In this embodiment, the top wall of the hollow chamber has a gas outlet 5 fixed thereon, and via said gas outlet 5 a gas destruction unit 4 is connected to the hollow chamber. The gas destruction unit 4, which in this specific case contains Carulite® catalyst, is configured to remove gas from the interior of the hollow chamber, destroy its ozone content and release via the exhaust 38 non-toxic exhaust gas to the environment. In FIG. 1, the width axis of the textile material 2, and the rotational axis of all types of the therein depicted rollers are substantially perpendicular to the plane of FIG. 1. Thus it is obvious that the textile materials execute a lengthwise motion when passing through the hollow chamber, and during said lengthwise motion the textile material travels along the length of the system and inside the hollow chamber successively passes through the upper and the lower part of the hollow chamber. Moreover, the width of the system and the length of the guide rollers is larger than the width of the textile material so that the latter can pass through the system and its rollers, being breadthwise spread out and uniformly in contact with each of the guide rollers. In this embodiment the travel path of the textile material 2 (and any of its lengthwise segments 3) inside the chamber is more than 10 m.

Figure 2:
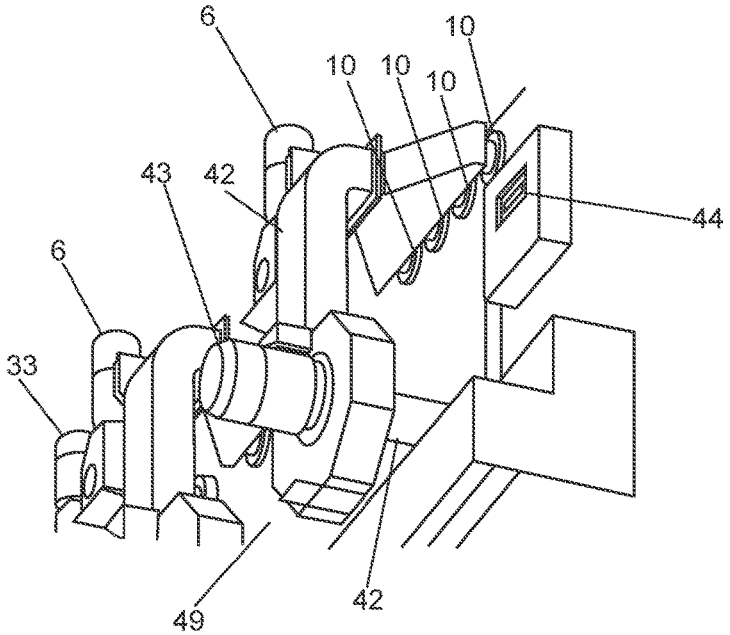
FIG. 2 is a three dimensional perspective of a part of the system as of FIG. 1, as seen from outside the system.
Figure 3:
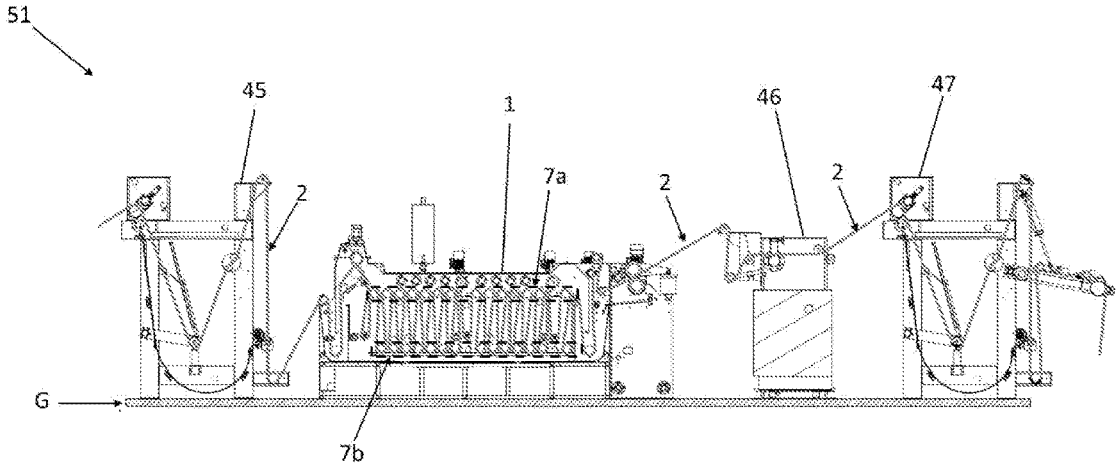
FIG. 3 is a schematic diagram of a cross section of a second preferred embodiment of the system when operated, which comprises the system of FIG. 1 as a part of the overall system.

FIG. 2 shows a three dimensional perspective of a part of the system 1 of FIG. 1, as seen from outside the system 1 and behind the back side wall 49 of the hollow chamber (hollow chamber 13 in FIG. 1). FIG. 2 shows the two traction motors 6, the external traction motor 33, and clearly shows four of said gas inlets 10. FIG. 2 also shows part of the tubing 42 connecting said gas inlets 10 to the ozone generating device (not shown), and also shows that attached to said tubing 42 there is a fan motor 43 which is connected to and drives a fan (not shown) located inside the tubing 42 and configured for increasing the flow at which the ozone gas is injected to the hollow chamber, so that the concentration of the ozone gas is substantially uniform inside the hollow chamber under normal system operation. Said fan essentially functions as the gas blower mentioned in relation the exemplary embodiment of first aspect of the invention. FIG. 2 also shows the gas analyzer 44 which is connected to the ozone concentration monitoring sensors 12 (not shown) depicted in FIG. 1. The gas analyzer 44 comprises a microprocessor system that is configured to receive and optionally analyze signals send by the ozone concentration monitoring sensors 12, and the gas analyzer optionally shows the measured ozone gas concentration via a display connected and controlled by said microprocessor system. FIG. 3 shows a second preferred embodiment of the system. The system 1 of FIG. 1 is part of the system 51 shown in FIG. 2. The system 51 also comprises the first accumulation unit 45, the dryer unit 46, and the second accumulation unit 47. For clarity of presentation, FIG. 3 also shows as a thick grey line the textile material 2 being present and spread out across the system 51 when said system 51 is operated. In addition, the drawn dashed-line rectangular boxes in FIG. 3 indicate a first 7*a* and a second 7*b* set of guide rollers respectively positioned in the upper and the lower part of the hollow chamber.

Figure 4:
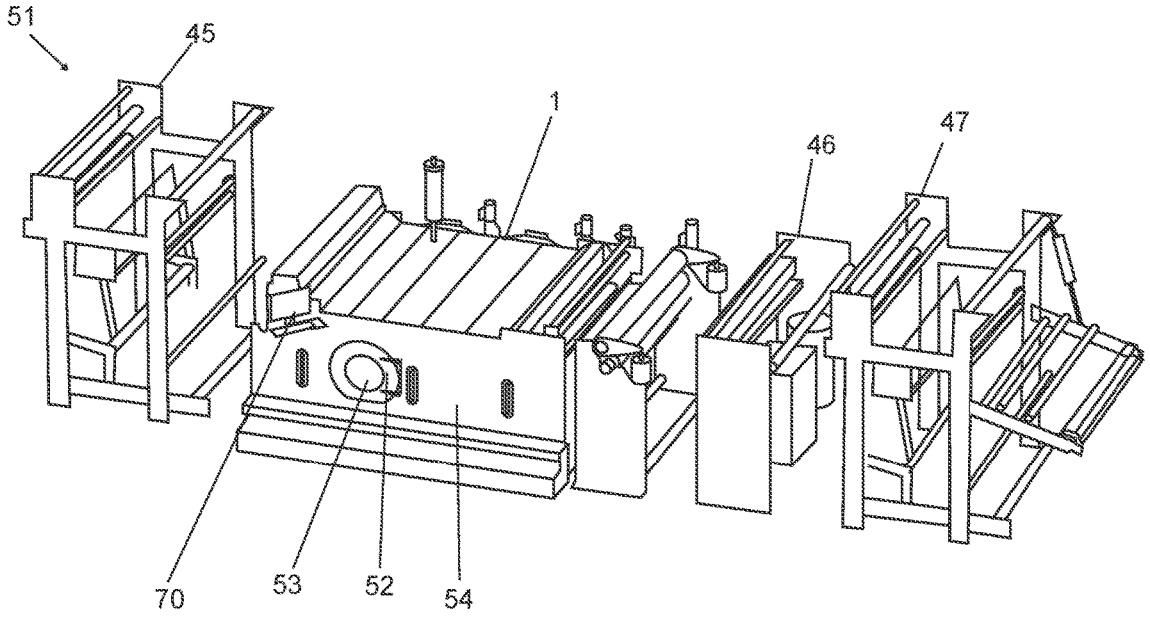
FIG. 4 is a three dimensional perspective of the system as of FIG. 3 as seen from outside the system.

FIG. 4 shows a three-dimensional perspective of the system 51 of FIG. 3, as seen from in front and above the system 51. As shown in FIG. 4, the front side wall 54 of the sub-system 1 (system 1 in FIG. 1) comprises a door 52 which comprises a glass window 53 for viewing inside the chamber when the door 52 is closed as shown. The system 51 also comprises a computer 70 which is connected to corresponding microprocessors of several of the electronic and/or electromechanical parts of the system 51, and is configured to monitor and control, according to the user's inputs, the operation of said parts and of the system 51, and in particular any of the process parameters which are critical for treating the textile material and preventing the formation of defects, examples of said parameters being: the linear speed with which the lengthwise segment pass through the hollow chamber 13, the value of the deflection force, the wet pickup of the textile material after passing through the first Foulard-type roller. For this reason, the system of the first aspect of the invention optionally comprises the computer 70, the latter being preferably connected to, monitoring the operation of, and controlling any of the following components of the system when said components are present: first and second Foulard-type roller 9,14 and their respective drive motors 37, 31 (each of these motors can be a component of the respective roller and can comprise microprocessors connected to the computer), any of driving rollers such as the external traction roller 32 and its corresponding motor 33 (the motor can be a component of the roller), the internal traction roller and its corresponding motor 6 (the motor can be a component of the roller), ozone generating device 40, fan and connected thereon motor 43, ozone concentration monitoring sensor 12, gas analyzer 44, gas destruction unit 4, dryer unit 46, liquid supply system, liquid purification unit. Obviously the system is connectable to at least one power supply unit, which can also be a component of the system and is connectable to an external power grid and powers the system and its various components. Said computer 70 can also be connected to said power unit (power unit not shown in any of the drawings). Moreover, the computer can be connectable to any other not mentioned above electromechanical or electronic components of the system such as valves, shutters, regulators etc. which are commonly present in industrial textile processing systems and often comprise microprocessors connectable with computers.

Figure 5:
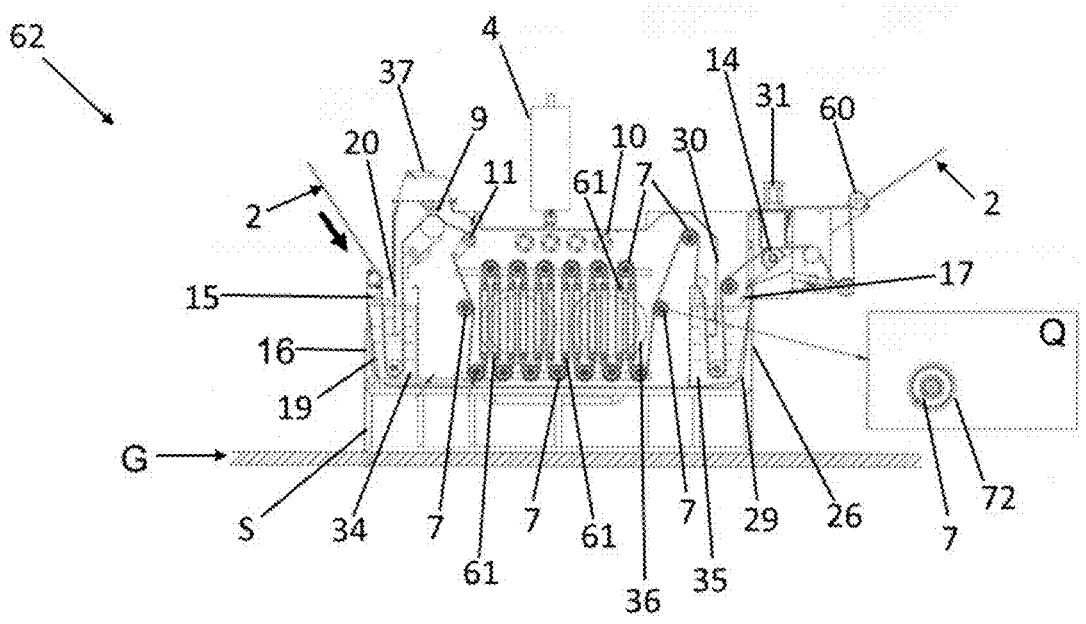
FIG. 5 is a third preferred embodiment of the system, wherein the system is intended to be used for treating textile material comprising an ensemble of non-weaved non-bonded between them yarns.

FIG. 5 describes another embodiment of the system of the first aspect of the invention. This embodiment is a preferred one when the textile material comprises non-weaved yarns. The system 61 of FIG. 5 has a similar structure to the system 1 shown in FIG. 1. Therefore, the components of system 62 of FIG. 5 which are substantially the same or serve substantially similar functionality as the aforementioned components of system 1, are described with the same reference numbers. The system 62 in FIG. 5 has the following distinct features: there are two large glass viewing windows 36 fixed on the back side wall of the chamber, there is the external tension compensator 60 right to the second Foulard-type roller 60, there are the separators 61, each of the guide rollers 7 of the plurality of guide rollers comprises fins 72 which are shown clearly in the inset Q of FIG. 5, said inset showing a magnified view of one of the guide rollers 7. In this case the longitudinal axis of each fin 72 is parallel to the rotational axis of the roller 7, and in between neighboring fins 72 there are gaps. For this reason, when the lengthwise segment 3 of the textile material 2 touches the guide roller 7, it is primarily making contact with the apex points of the fins 72, and in between neighboring fins 72 each yarn of the lengthwise segment 3 is not making contact with the guide roller 7, and this facilitates the uniform ozone treatment of the yarn and the prevention of the formation of ozone induced defects. Each of the separators 61, essentially is a bar parallel to the guide rollers and fixed on either or both of the front and back side wall (not shown/marked with reference sign in FIG. 5) of the hollow chamber 13, or on an additional support structure fixed thereon. When the system 62 is operated, each separator 61 serves the purpose of keeping a first set of yarns of the lengthwise segment (passing by said separator 61) spatially separated from a second set of yarns of the lengthwise segment, so that each yarn of each corresponding first and second set is more uniformly treated by the ozone gas as it moves through the chamber and in between the successive guide rollers 7, as indicated by FIG. 5. Therefore, the separators contribute to the prevention of the formation of ozone induced defects, forming with the at least one tension compensator 11 and the plurality of guide rollers 7 a synergistic effect.

Figure 6:
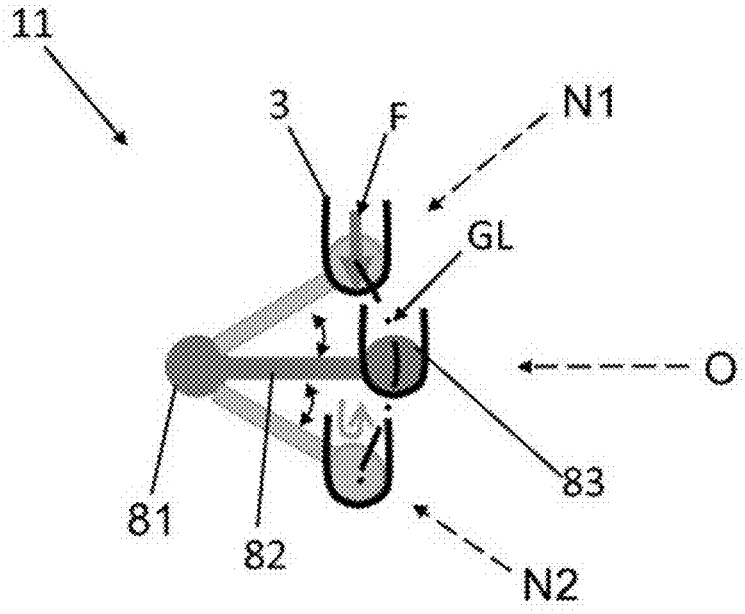
FIG. 6 is a schematic diagram of a cross section of an embodiment of the tension compensator, and shows 3 different working positions of the tension compensator.

FIG. 6 shows a cross section of an example of a tension compensator 11, which in this case is a common type of a tension compensator, and describes its operation. In this case, the tension compensator comprises the first shaft 81 which is attached and is substantial perpendicular to any or both of the back and front side wall (not shown) of the system (not shown). The longitudinal axis of the first shaft 81 is perpendicular to the plane of FIG. 6, and the first shaft 81 can rotate around said axis, as indicated by the shown double arrows. Attached to and supported by the first shaft 81 there is the connector 82 which is also attached to and supports the contact part 83. The contact part 83 is also a shaft parallel to the first shaft 81. The connector 82 is attached to one edge of the contact part 83 and does not contact the lengthwise segment 3 of the textile material, thus it does not hinder the slide of the latter around the contact part 83. Obviously a second connector (not shown), similarly configured with the shown connector 82, can be attached to the other (opposite) edge (not shown) of the contact part 83. The connector 82, and thus the contact part 83, can also pivot around the longitudinal axis of the first shaft 81, following the movement of the latter when it rotates. The lengthwise segment 3 (textile material) contacts the contact part 83 when passing through the tension compensator 11. The direction of the movement of the lengthwise segment 3 as it passes by the tension compensator 11 is indicated in FIG. 6 by the thick grey curved arrow. When the contact part 83 contacting the lengthwise segment 3 is at the position O or at any position along the hypothetical line GL (indicated by the dashed-dotted line) that includes position O and is in between the positions N1 and N2, then the deflection force F has the prevention value and the fibers (not shown) of the lengthwise segment 3 are at an optimum mechanical state for being treated with ozone. When the contact part 83 with the lengthwise segment 3 are at position O, and then the lengthwise segment 3 is pulled upwards towards position N1 by external forces not shown, then the tension compensator 11, meaning its contact part 83, pivots moving along said line and towards position N1, thus preventing stressing of the textile and keeping the deflection force F, applied by the contact part to the textile material, at a defect prevention value. Similarly, when the contact part 83 with the lengthwise segment 3 are at position O, and then the lengthwise segment 3 becomes loose lengthwise and the action force applied from the textile material to the contact part tends to decrease, then the tension compensator 11 pivots moving along said line GL and towards position N2 for keeping the textile material tensed and the deflection force F at a defect prevention value. Preferably, the tension compensator 11 comprises a sensor for measuring the value of the deflection force related to the interaction between the tension compensator 11 and the lengthwise segment 3, or measuring a physical parameter correlated to said value of the deflection force. For example, in the case of the example of FIG. 6, the sensor is an inclinometer that measures the angle between the position of the tension compensator contact part 83 and connector 82 with respect to position O. These types of sensors, such as inclinometers, potentiometers and load cells, are well known and widely used in tension compensators. The tension compensator 11 preferably is adjusted automatically for maintaining that the deflection force has the prevention value. Nevertheless, it is also contemplated that is adjusted manually by the user of the system, or is adjusted by an actuator which adjusts the position of the tension compensator.

An example of a sensor used with the tension compensator and being configured to measure the position of the contact part and thus measure/indicate the force/load applied from textile material to the tension compensator and the corresponding deflection force applied from the tension compensator to the textile material when the tension compensator is positioned along the geometrical line GL, is the Magnetic Field positioning system BMP000Z by Balluf. Another example of the sensor, is the Novohall rotary sensor (series RFC4800) that for example is used attached/integrated to the aforementioned rotating first shaft 81.

Figure 7:
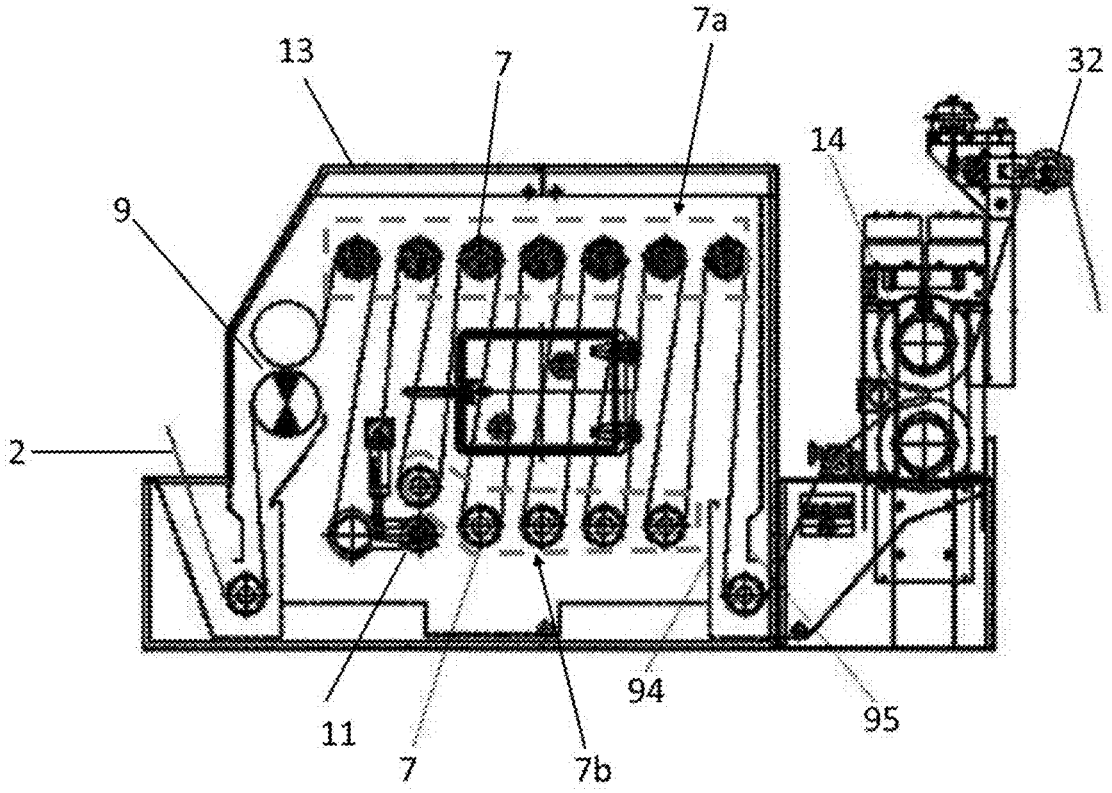
FIG. 7 is a schematic diagram of a cross section of the exemplary embodiment of the first aspect of the invention.

The exemplary embodiment is further described by FIG. 7. The device for removing floating color with ozone as shown in FIG. 7 comprises a hollow chamber 13, wherein a left side wall of the hollow chamber is provided with a textile-feeding port, and a right side wall of the hollow chamber is provided with a textile-discharging port; the hollow chamber is internally provided with guide rollers 7 for changing a moving direction of denim, the guide rollers 7 are divided into two groups depending on their positions, each group has at least two guide rollers, one group 7*a* is fixed on an upper part of the hollow chamber and the other group is fixed on a lower part of the hollow chamber; a driving roller which a second Foulard-type roller 14 for driving the denim to move from left to right, and pressing the passing textile, is fixed above the textile-discharging port through a support, and a rotating shaft of said driving roller is connected with a rotating shaft of a driving motor through a transmission mechanism; and an air inlet is arranged in the hollow chamber and is communicated with an air outlet port of an air intake pipe, and an air inlet port of the air intake pipe is communicated with an air outlet nozzle of an ozone generating device. The driving roller drives the textile 2, which is tensioned on the guide rollers, to move from left to right, and meanwhile, the ozone generating device (not shown) generates ozone and delivers ozone to the hollow chamber. As also shown in FIG. 7, the device also comprises a tension compensator 11, a second driving roller which is an external traction roller 32, and a third driving roller which is a First Foulard-type roller 9 configured to pressing the passing textile denim.

This embodiment can be used for removing the floating color from the cloth and hard printed textile, and can avoid dyeing caused by rinsing.

In the exemplary embodiment the upper part of the hollow chamber is sealed, the hollow chamber is only provided with the textile-feeding port, the textile-discharging port, the air inlet and the air outlet, and the air outlet is communicated with an air inlet port of an air outlet pipe. The textile-feeding port and the textile-discharging port are both provided with a sealing structure for preventing ozone from overflowing therefrom. Please note that the sealing structure can be used to reduce/prevent, but not completely eradicate, the leakage of ozone. Preferably, the sealing structure comprises a first partition plate 95, the top part of the first partition plate 95 is abutted against the top of the hollow chamber, and a gap is arranged between the bottom part of the first partition plate 95 and the bottom of the hollow chamber; the sealing structure further comprises a second partition plate 94, the bottom part of the second partition plate 94 is abutted against the bottom of the hollow chamber, and a gap is arranged between the top part of the second partition plate 94 and the top part of the hollow chamber; the first partition plate 95 is located between a side wall of the hollow chamber and the second partition plate 94; and the height at which the bottom of the first partition plate 95 locates, is lower than the height at which the top part of the second partition plate 94 locates; water fills between the side wall and the first partition plate and between the first partition plate and the second partition plate 94; and the height at which the water level of the water locates, is lower than the height at which the top part of the second partition plate 94 locates, but is higher than the height at which the bottom of the first partition plate 95 locates; two guide rollers fixed at the lower part of the system are located immersed in the water; and the textile-feeding port and the textile-discharging port are opened on the side wall of the hollow chamber outside the first partition plate 95. According to the present invention, the structure of a hollow chamber body is optimized, and uses the partition plate and the side wall to form a water sealing structure which can effectively prevent the overflow of ozone and reduce the entry of water into the hollow part inside the second partition plate. Of course, other liquids can be used to replace water to realize the sealing.

In the exemplary embodiment the air inlet is preferably located at the top of the hollow chamber inside the first partition plate, and also can be located in the bottom or side wall of the hollow chamber inside the second partition plate. Preferably, the air inlet is provided with a three-way valve, one valve port of which is communicated with the hollow chamber, one valve port is communicated with the air outlet port of the air intake pipe, one valve port is communicated with the air outlet port of an air-guide pipe. The air inlet port of the air-guide pipe is connected with the air outlet of an air blower. In this way, the air pressure at the air inlet can be increased by means of the air blower, thereby increasing the action intensity of ozone with the denim, and improving the effect of removing the floating color. Preferably, the air intake pipe is provided with a flow valve, so that the inflating volume of ozone can be adjusted through the flow valve, so as to control the ozone amount in the hollow chamber. Further, an ozone concentration-monitoring sensor is arranged in the hollow chamber, and is connected with a microprocessor system which is connected with a control system of the ozone generating device, so as to adjust ozone generating speed according to the concentration of ozone and further to control the ozone amount in the hollow chamber.

A preferred embodiment of the method of the second aspect of the invention is as follows:

using the system described above in relation to FIG. 1 and supplying its first tank with the first liquid and forming the first liquid pool of the first liquid inside the first tank, and supplying the second tank with the second liquid and forming the pool of the second liquid inside the second tank, both the first liquid and the second liquid being water, and spreading out the textile material across the system according the first aspect of the invention, and operating said system supplying the hollow chamber with ozone gas at the desired ozone concentration value, using the ozone generating device, using the driving rollers passing the textile material through the system, meaning driving the textile material the successively move through the pool of the first liquid, through the interior of the hollow chamber, and through the pool of the second liquid, and preventing the formation of ozone-induced defects on the textile material by controlling the tension of the textile material using the tension compensator and with the latter's movable contact part applying to the textile material a deflection force of a value constantly of between 0.5 N and 400 N.

Preferably, the textile material is being spread out similarly to what is indicated by FIG. 1. Preferably the first and the second liquids are water. Preferably the desired ozone concentration value is of between 2 g/Nm$^3$ and 150 g/Nm$^3$.

Preferably the passing the textile material is done at a linear speed of between 5 m/min and 140 m/min. Also preferably when passing the textile material, the method comprises adjusting the rotational speed of any of the plurality of driving rollers, thusly additionally controlling the tension of the textile material.

Preferably, the system comprises the first Foulard-type roller, and operating the system comprises adjusting the former to squeeze out water from the lengthwise segment so that the wet pickup value of the later when exiting the first Foulard-type roller is of between 30% and 90%.

In another embodiment of the method the hollow chamber is configured so that therein the textile material follows a travel path of a length of between 10 m and 200 m, and in the third step of the method passing the textile material through the hollow chamber at a linear speed of between 5 m/min and 140 m/min, and the desired ozone concentration value is of between 2 g/Nm$^3$ and 150 g/Nm$^3$.

The inventors have observed that by implementing the invention, the formation of ozone induced defects is significantly prevented compared to what is achieved with the prior art. The implementation of the invention can result to a 2-fold decrease of the number of ozone induced defects that appear on the textile material, or to a substantially larger decrease of the number of defects, compared to what is achieved when only applying the teachings of the prior art.

The above shows and describes the basic principle, the main features and advantages of the present invention. Those skilled in the art shall know that the present invention is not limited by the embodiments above, the embodiments and the descriptions above only describe the principle of the present invention. The present invention may also have various changes and improvements without deviating from the scope of the present invention, and the changes and improvements shall all fall within the scope of the protection of the present invention. The scope of the protection of the present invention is defined by the attached claims.

The invention claimed is:

1. A system for treating a textile material with ozone gas, the system comprising a hollow chamber comprising an interior with a plurality of guide rollers, the plurality of guide rollers being configured to contact and guide the textile material to pass, being lengthwise tensed and breadthwise spread out, through the hollow chamber;

an ozone supply system that is an ozone generating device connected to the hollow chamber and configured to supply to ozone gas at a desired concentration value;

a textile-feeding port that is adjacent and connected to the hollow chamber, and comprises a first tank that is configured to contain a first pool of a first liquid preventing the leak of ozone through the textile-feeding port when the system is operated;

a textile-discharging port that is adjacent and connected to the main chamber, and comprises a second tank that is configured to contain a second pool of a second liquid preventing the leak of ozone through the textile-discharging port when the system is operated;

a plurality of driving rollers configured to drive the textile material to move through the system; wherein the system is configured so that the textile material successively passes through the first pool, through the interior of the hollow chamber, and through the second pool; and an ozone concentration monitoring sensor arranged in the hollow chamber and connected with a microprocessor system, the microprocessor system being connected with a control system of the ozone generating device for adjusting an ozone generating speed of said ozone generating device according to the desired ozone concentration value, said desired ozone concentration value being between 2 g/Nm$^3$ and 150 g/Nm$^3$, and the interior of the hollow chamber comprises:

at least one tension compensator configured to control the tension of the textile material when the textile material passes through the hollow chamber.

2. The system according to claim 1, wherein the tension compensator further comprises:

a contact part that is configured to contact the textile material and be movable along a geometrical line in between a corresponding first working position and a second working position and control the tension of the textile material by deflecting applying to it a deflection force between 0.5 N and 400 N when the textile material along its length intersects said geometrical line.

3. The system according to claim 1, wherein the plurality of guide rollers further comprises:

at least two groups of guide rollers, each of a first group and a second group of the at least two groups has at least two guide rollers, the first group is fixed on an upper part of the hollow chamber and the second group is fixed on a lower part of the hollow chamber, the plurality of guide rollers being also configured to guide the textile material to pass through both the upper part and the lower part of the interior of the hollow chamber.

4. The system according to claim 1, wherein the interior of the hollow chamber further comprises:

at least one sensor configured to measure the deflection force.

5. The system according to claim 1, wherein the plurality of driving rollers further comprises:

a second Foulard-type roller fixed next to the textile material-discharging port and outside the hollow chamber, wherein the second Foulard-type roller is configured to receive the textile material exiting the textile material-discharging port and is also configured to squeeze out liquid from the textile material.

6. The system according to claim 1, wherein the plurality of driving rollers further comprises:

at least one internal traction roller disposed in the interior of the hollow chamber, the at least one internal traction roller being configured to contact the textile material and drive the textile material to pass through the hollow chamber.

7. The system according to claim 1, wherein the plurality of driving rollers further comprises:

at least one external traction roller located outside the hollow chamber and configured to be in contact with the textile material and the textile material to pass through the hollow chamber.

8. The system according to claim 1, wherein at least one of the plurality of driving rollers further comprises:

a drive motor that comprises a microprocessor that is configured to control and adjust the rotational speed of the respective driving roller.

9. The system according to claim 1, wherein the system further comprises:

an ozone gas destruction unit connected to the hollow chamber and configured to extract and destroy the ozone gas from the interior of the hollow chamber.

10. The system according to claim 1, wherein the system further comprises:

a liquid supply system connected to the first tank and/or the second tank and configured to supply thereof the first liquid and/or the second liquid.

11. The system according to claim 1, wherein the system further comprises:

a liquid purification unit connected to the first tank and/or the second tank and configured to receive liquid therefrom, and to remove from said liquid fibers released by the textile material, and chemical byproducts produced by the treatment of the textile material and passed to the liquid.

12. The system according to claim 1, wherein each of the guide rollers of the plurality of guide rollers further comprises:

fins configured to reduce the contact area between the textile material and the guide rollers.

13. The system according to claim 1, wherein the system treats an ensemble of non-weaved and non-bonded between them yarns, wherein the interior of the hollow chamber, between at least two of the guide rollers of the plurality of guide rollers, comprises at least one separator configured to spatially separate at its vicinity a first set of the yarns of the textile material from a second set of the yarns of the textile material.

14. The system according to claim 1, wherein the system further comprises:

at least one dyeing unit located outside the hollow chamber, the textile-feeding port and the textile-receiving port and configured to dye the textile material.

15. The system according to claim 1, wherein the system further comprises:

a dryer unit configured to dry the textile material exiting the textile-discharging port.

16. The system according to claim 1, wherein the system further comprises:

a second accumulation unit configured to receive and at least partially accumulate the textile material exiting the textile-discharging port.

17. The system according to claim 1, wherein the system further comprises:

a first accumulation unit which is configured to receive and at least partially accumulate the textile material and pass the textile material to the textile-feeding port.

18. The system according to claim 1, wherein each of the guide rollers of the plurality of guide rollers has a diameter between 50 mm and 500 mm.

19. The system according to claim 1, wherein each two consecutive guide rollers along a travel path that the textile material follows inside the hollow chamber guide rollers of the plurality of guide rollers are disposed so that the length of the travel path's part in between said consecutive guide rollers is between 20 cm and 200 cm.

20. A method for treating a textile material with ozone gas, the textile material being a fabric or an ensemble of non-weaved and non-bonded between them yarns, the method comprising the steps of:

providing a first liquid to a first tank and a second liquid to a second tank of a system that is according to claim 1;

supplying the hollow chamber of the system with the ozone gas at a desired ozone concentration value, by using the ozone generating device of the system;

passing the textile material tensed through the system, by using the plurality of driving rollers and the plurality of guide rollers of the system;

wherein the desired ozone concentration value is between 2 g/Nm$^3$ and 150 g/Nm$^3$, and controlling the tension of the textile material inside the hollow chamber by using the tension compensator of the system.

21. The method according to claim 20, wherein the tension compensator comprises a contact part that is configured to contact the textile material, and be movable along a geometrical line in between a corresponding first working position and a second working position, and control the tension of the textile material by applying to it a deflection force between 0.5 N and 400 N when the textile material along its length intersects said geometrical line, and controlling the tension of the textile material comprises applying to the textile material the deflection force between 0.5 N and 400 N using the tension compensator.

22. The method according to claim 20, wherein the plurality of driving rollers of the system comprise a first Foulard-type roller fixed inside the interior of the hollow chamber and next to the textile material-feeding port, and wherein the third step of the method further comprises squeezing out liquid from the textile material by using the first Foulard-type roller thusly, adjusting the wet pickup value of the textile material, when exiting the first Foulard-type roller, to be between 30% and 90%.

23. The method according to claim 20, further comprising:

passing the textile material through the hollow chamber at a linear speed between 5 m/min and 140 m/min.

24. The method according to claim 20, further comprising:

adjusting the rotational speed of any of the plurality of the driving rollers thusly, further controlling the tension of the textile material.

25. The method according to claim 20, further comprising:

dyeing the textile material.

26. The method according to claim 20, wherein the textile material is a denim fabric, the hollow chamber is configured so that therein the textile material follows a travel path of a length between 10 m and 35 m, the desired ozone concentration value is between 2 g/Nm$^3$ and 30 g/Nm$^3$, and passing the textile material through the hollow chamber at a linear speed between 25 m/min and 50 m/min.

27. The method according to claim 20, wherein the textile material is a denim fabric, the hollow chamber is configured so that inside it the textile material follows a travel path of a length between 10 m and 35 m, the desired ozone concentration value is between 25 g/Nm$^3$ and 150 g/Nm$^3$, and passing the textile material through the hollow chamber at a linear speed between 50 m/min and 140 m/min.

28. The method according to claim 20, further comprising:

passing the textile material through the hollow chamber at a linear speed between 25 m/min and 50 m/min, and the desired ozone concentration value is between 2 g/Nm$^3$ and 15 g/Nm$^3$.

29. The method according to claim 20, wherein the ozone concentration value is between 10 g/Nm$^3$ and 150 g/Nm$^3$, and passing the textile material through the hollow chamber at a linear speed between 20 m/min and 150 m/min.

30. The method according to claim 20, wherein the textile material is denim fabric dyed with indigo, reactive and/or sulfur dyes, the desired ozone concentration value is between 2 g/Nm$^3$ and 15 g/Nm$^3$, and passing the textile material through the hollow chamber at a linear speed between 25 m/min and 50 m/min.

31. The method according to claim 20, wherein the textile material is fabric that is raw and/or in greige state, the desired ozone concentration value is 20 g/Nm$^3$, and passing the textile material through the hollow chamber at a linear speed of 40 m/min.

32. The method according to claim 20, wherein the textile material comprises wool, the desired ozone concentration value is between 15 g/Nm$^3$ and 30 g/Nm$^3$, and passing the textile material through the hollow chamber at a linear speed between 25 m/min and 50 m/min.

33. The method according to claim 20, wherein and the desired ozone concentration value is between 5 g/Nm$^3$ and 30 g/Nm$^3$, and passing the textile material through the hollow chamber at a linear speed between 25 m/min and 50 m/min.

* * * * *